US010213903B2

(12) United States Patent
Serebrennikov et al.

(10) Patent No.: US 10,213,903 B2
(45) Date of Patent: Feb. 26, 2019

(54) ABRASIVE ARTICLE HAVING A CORE INCLUDING A POLYMER MATERIAL

(71) Applicants: SAINT-GOBAIN ABRASIVES, INC., Worcester, MA (US); SAINT-GOBAIN ABRASIFS, Conflans-Sainte-Honorine (FR)

(72) Inventors: Boris L. Serebrennikov, Shrewsbury, MA (US); Debdutta Roy, Kolkata (IN); John Tunstall, Buffalo Grove, IL (US); Arup K. Khaund, Northborough, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 13 days.

(21) Appl. No.: 15/669,284

(22) Filed: Aug. 4, 2017

(65) Prior Publication Data

US 2017/0334040 A1 Nov. 23, 2017

Related U.S. Application Data

(63) Continuation of application No. 14/725,925, filed on May 29, 2015, now Pat. No. 9,764,449.

(60) Provisional application No. 62/004,275, filed on May 29, 2014.

(51) Int. Cl.
*B24D 5/06* (2006.01)
*B24D 18/00* (2006.01)

(52) U.S. Cl.
CPC ..... *B24D 5/06* (2013.01); *B24D 18/0009* (2013.01)

(58) Field of Classification Search
CPC ..... B24D 5/06; B24D 18/0009
USPC ..... 451/541
See application file for complete search history.

(56) References Cited

U.S. PATENT DOCUMENTS

| | | | |
|---|---|---|---|
| 1,209,831 | A | 12/1916 | Gardner |
| 1,910,444 | A | 5/1933 | Nicholson |
| 2,161,725 | A | 6/1939 | Smith |
| 2,174,902 | A | 10/1939 | Stratford |
| 2,241,433 | A | 5/1941 | Walker |
| 2,279,278 | A | 4/1942 | Shue |
| 2,353,864 | A | 7/1944 | Wooddell |
| 2,378,271 | A | 6/1945 | Wheildon, Jr. |

(Continued)

FOREIGN PATENT DOCUMENTS

| | | | |
|---|---|---|---|
| CN | 1927918 | A | 3/2007 |
| CN | 102154913 | A | 8/2011 |

(Continued)

OTHER PUBLICATIONS

Wu. C.-H. and Liang, W.-J. (2005), Effects of geometry and injection-molding parameters on weld-line strength. Polymer Engineering & Science, 45: 1021-1030.

(Continued)

*Primary Examiner* — George Nguyen
(74) *Attorney, Agent, or Firm* — Abel Law Group, LLP; Joseph P. Sullivan

(57) ABSTRACT

An abrasive article in form of an abrasive wheel comprising a core and a bonded abrasive body disposed within an interior recess of a peripheral surface of a core. The core comprises a polymer material and has an HDT at 0.45 MPa of at least about 130° C., and a low shrinkage ratio.

20 Claims, 7 Drawing Sheets

(56) References Cited

U.S. PATENT DOCUMENTS

| | | | |
|---|---|---|---|
| 2,418,883 | A | 4/1947 | Homeyer |
| 2,492,143 | A | 12/1949 | Gipple et al. |
| 2,752,634 | A | 7/1956 | Rengering |
| 2,958,593 | A | 11/1960 | Hoover et al. |
| 2,958,693 | A | 11/1960 | Phillips |
| 3,041,156 | A | 6/1962 | Rowse et al. |
| 3,043,063 | A | 7/1962 | Peterson |
| 3,152,949 | A | 10/1964 | Guthrie |
| 3,362,114 | A | 1/1968 | Hurst |
| 3,372,220 | A | 3/1968 | Stingley |
| 3,436,874 | A | 4/1969 | Betzler |
| 3,500,592 | A | 3/1970 | Harrist |
| 3,540,163 | A | 11/1970 | Shoemaker |
| 3,576,090 | A | 4/1971 | Shoemaker |
| 3,707,059 | A | 12/1972 | Burtch et al. |
| 3,800,483 | A | 4/1974 | Sherman |
| 3,830,020 | A | 8/1974 | Gomi |
| 3,846,534 | A | 11/1974 | Hallinan et al. |
| 3,861,955 | A | 1/1975 | Lemelson |
| 3,880,812 | A | 4/1975 | Golinkin et al. |
| 3,991,526 | A | 11/1976 | Frank et al. |
| 4,054,425 | A | 10/1977 | Sherman |
| 4,088,729 | A | 5/1978 | Sherman |
| 4,186,536 | A | 2/1980 | Piazza |
| 4,227,350 | A | 10/1980 | Fitzer |
| 4,311,489 | A | 1/1982 | Kressner |
| 4,314,827 | A | 2/1982 | Leitheiser et al. |
| 4,369,046 | A | 1/1983 | Bruschek et al. |
| 4,437,271 | A | 3/1984 | McAvoy |
| 4,448,590 | A | 5/1984 | Wray et al. |
| 4,457,113 | A | 7/1984 | Miller |
| 4,541,207 | A | 9/1985 | Antonson |
| 4,588,420 | A | 5/1986 | Charvat |
| 4,623,364 | A | 11/1986 | Cottringer et al. |
| 4,652,275 | A | 3/1987 | Bloecher et al. |
| 4,744,802 | A | 5/1988 | Schwabel |
| 4,770,671 | A | 9/1988 | Monroe et al. |
| 4,774,788 | A | 10/1988 | Shacham et al. |
| 4,799,939 | A | 1/1989 | Bloecher et al. |
| 4,881,951 | A | 11/1989 | Wood et al. |
| 4,941,293 | A | 7/1990 | Ekhoff |
| 4,951,341 | A | 8/1990 | Shears |
| 5,009,675 | A | 4/1991 | Kunz et al. |
| 5,011,508 | A | 4/1991 | Wald et al. |
| 5,042,991 | A | 8/1991 | Kunz et al. |
| 5,090,968 | A | 2/1992 | Pellow |
| 5,144,001 | A | 9/1992 | Maresca |
| 5,201,149 | A | 4/1993 | Eisenblatter |
| 5,201,916 | A | 4/1993 | Berg et al. |
| 5,209,760 | A | 5/1993 | Wiand |
| 5,213,591 | A | 5/1993 | Celikkaya et al. |
| 5,232,470 | A | 8/1993 | Wiand |
| 5,232,975 | A | 8/1993 | Deakyne |
| 5,249,566 | A | 10/1993 | Sawluk |
| 5,273,558 | A | 12/1993 | Nelson et al. |
| 5,408,983 | A | 4/1995 | Sawluk |
| 5,436,700 | A | 7/1995 | Kikuchi et al. |
| 5,443,906 | A | 8/1995 | Pihl et al. |
| 5,549,962 | A | 8/1996 | Holmes et al. |
| 5,560,070 | A | 10/1996 | Reaume |
| 5,573,844 | A | 11/1996 | Donovan et al. |
| 5,584,897 | A | 12/1996 | Christianson et al. |
| 5,593,467 | A | 1/1997 | Monroe |
| 5,607,488 | A | 3/1997 | Wiand |
| 5,632,790 | A | 5/1997 | Wiand |
| 5,645,618 | A | 7/1997 | Monroe et al. |
| 5,651,801 | A | 7/1997 | Monroe et al. |
| 5,671,511 | A | 9/1997 | Hattori et al. |
| 5,736,081 | A | 4/1998 | Yamakawa et al. |
| 5,849,646 | A | 12/1998 | Stout et al. |
| 5,876,470 | A | 3/1999 | Abrahamson |
| 5,895,612 | A | 4/1999 | Warner et al. |
| 5,928,070 | A | 7/1999 | Lux |
| 5,975,988 | A | 11/1999 | Christianson |
| 5,989,114 | A | 11/1999 | Donahue et al. |
| 5,996,167 | A | 12/1999 | Close |
| 6,001,202 | A | 12/1999 | Penttila et al. |
| 6,004,363 | A | 12/1999 | Pisacane et al. |
| 6,066,188 | A | 5/2000 | Benedict et al. |
| 6,074,278 | A | 6/2000 | Wu et al. |
| 6,083,445 | A | 7/2000 | Warner et al. |
| 6,093,092 | A | 7/2000 | Ramanath et al. |
| 6,110,027 | A | 8/2000 | Müller |
| 6,179,887 | B1 | 1/2001 | Barber, Jr. |
| 6,261,156 | B1 | 7/2001 | Johnson et al. |
| 6,302,930 | B1 | 10/2001 | Lux |
| 6,358,133 | B1 | 3/2002 | Cesena et al. |
| 6,371,842 | B1 | 4/2002 | Romero |
| 6,465,102 | B1 | 10/2002 | Honigfort et al. |
| 6,521,004 | B1 | 2/2003 | Culler et al. |
| 6,569,934 | B2 | 5/2003 | Noel, III |
| 6,620,214 | B2 | 9/2003 | McArdle et al. |
| 6,638,144 | B2 | 10/2003 | Sventek et al. |
| 6,679,758 | B2 | 1/2004 | Bright et al. |
| 6,769,964 | B2 | 8/2004 | Tunstall |
| 6,786,801 | B2 | 9/2004 | Mann |
| 6,811,582 | B1 | 11/2004 | Wurzer et al. |
| 6,846,223 | B2 | 1/2005 | Conley et al. |
| 6,863,596 | B2 | 3/2005 | Fritz et al. |
| 6,942,559 | B2 | 9/2005 | Klotz |
| 7,121,924 | B2 | 10/2006 | Fritz et al. |
| 7,351,133 | B1 | 4/2008 | Lemberger et al. |
| 8,113,921 | B2 | 2/2012 | Krauss et al. |
| 8,137,423 | B2 | 3/2012 | Lise et al. |
| 8,377,368 | B2 | 2/2013 | Grauer |
| 8,641,481 | B2 | 2/2014 | Francois et al. |
| 8,691,139 | B2 | 4/2014 | Grauer |
| 8,740,675 | B2 | 6/2014 | Wu et al. |
| 9,434,051 | B2 | 9/2016 | Wu et al. |
| 9,764,449 | B2 * | 9/2017 | Serebrennikov ... B24D 18/0009 |
| 2001/0011108 | A1 | 8/2001 | Thurber et al. |
| 2002/0019199 | A1 | 2/2002 | Goers et al. |
| 2002/0095871 | A1 | 7/2002 | McArdle et al. |
| 2002/0132572 | A1 | 9/2002 | Lageson et al. |
| 2002/0177387 | A1 | 11/2002 | Keipert et al. |
| 2003/0054745 | A1 | 3/2003 | Bergquist et al. |
| 2003/0113509 | A1 | 6/2003 | Lugg |
| 2004/0004306 | A1 | 1/2004 | Sawyer et al. |
| 2005/0233678 | A1 | 10/2005 | Fritz et al. |
| 2007/0037501 | A1 | 2/2007 | Buljan et al. |
| 2007/0141969 | A1 | 6/2007 | Cybulski et al. |
| 2008/0182487 | A1 | 7/2008 | Müller et al. |
| 2009/0017736 | A1 | 1/2009 | Block et al. |
| 2009/0023366 | A1 | 1/2009 | Lise et al. |
| 2009/0098807 | A1 | 4/2009 | Bakshi et al. |
| 2009/0151267 | A1 | 6/2009 | Upadhyay et al. |
| 2009/0209186 | A1 | 8/2009 | Krauss et al. |
| 2010/0022169 | A1 | 1/2010 | Asen |
| 2010/0151778 | A1 | 6/2010 | Telischak, Jr. et al. |
| 2010/0159806 | A1 | 6/2010 | Wu et al. |
| 2010/0159813 | A1 | 6/2010 | Pajovic |
| 2010/0190420 | A1 | 7/2010 | Yamahara |
| 2010/0190424 | A1 | 7/2010 | Francois et al. |
| 2010/0210194 | A1 | 8/2010 | Thomaschewski et al. |
| 2011/0140314 | A1 | 6/2011 | Grauer |
| 2012/0231712 | A1 | 9/2012 | Wu et al. |
| 2013/0115436 | A1 | 5/2013 | Hahn et al. |
| 2013/0203328 | A1 | 8/2013 | Givot et al. |
| 2015/0298375 | A1 | 10/2015 | Franssen et al. |

FOREIGN PATENT DOCUMENTS

| | | | |
|---|---|---|---|
| DE | 1051683 | B | 2/1959 |
| DE | 3301210 | A1 | 7/1984 |
| DE | 19501201 | A1 | 7/1996 |
| DE | 19951250 | A1 | 5/2001 |
| DE | 10210673 | A1 | 9/2003 |
| DE | 10361101 | A1 | 4/2005 |
| DE | 10 2015011442 | A1 | 3/2017 |
| EP | 451944 | A2 | 10/1991 |
| EP | 551714 | A1 | 7/1993 |
| EP | 554806 | A1 | 8/1993 |
| EP | 790880 | B1 | 8/1997 |
| EP | 0920959 | A2 | 6/1999 |

(56) References Cited

FOREIGN PATENT DOCUMENTS

| | | | |
|---|---|---|---|
| EP | 1010495 | A2 | 6/2000 |
| EP | 1018404 | A2 | 7/2000 |
| EP | 1666230 | A1 | 6/2006 |
| EP | 1105252 | B1 | 2/2007 |
| EP | 1795304 | A1 | 6/2007 |
| FR | 1178553 | A | 5/1959 |
| FR | 2388538 | A1 | 11/1978 |
| FR | 2776553 | A1 | 10/1999 |
| GB | 491658 | A | 9/1938 |
| GB | 790003 | A | 1/1958 |
| GB | 951450 | | 3/1964 |
| GB | 1420295 | A | 1/1976 |
| GB | 2247201 | A | 2/1992 |
| GB | 2304071 | A | 3/1997 |
| GB | 2382023 | A | 5/2003 |
| JP | S58171263 | A | 10/1983 |
| JP | S6161169 | A | 3/1986 |
| JP | H05229071 | A | 9/1993 |
| JP | H11320423 | A | 11/1999 |
| JP | 2000006036 | A | 1/2000 |
| JP | 2001025957 | A | 1/2001 |
| JP | 2007331058 | A | 12/2007 |
| KR | 20020095941 | A | 12/2002 |
| KR | 20030028233 | A | 4/2003 |
| WO | 00/78506 | A1 | 12/2000 |
| WO | 02/32832 | A1 | 4/2002 |
| WO | 02/33019 | A1 | 4/2002 |
| WO | 02/33030 | A1 | 4/2002 |
| WO | 02/094506 | A1 | 11/2002 |
| WO | 2003045634 | A1 | 6/2003 |
| WO | 2005115716 | A1 | 12/2005 |
| WO | 2006023178 | A1 | 3/2006 |
| WO | 2009009558 | A1 | 1/2009 |
| WO | 2012000647 | A1 | 1/2012 |
| WO | 2015100034 | A1 | 7/2015 |
| WO | 2015184344 | A1 | 12/2015 |

OTHER PUBLICATIONS

International Search Report for Application No. PCT/US2015/033312, dated Sep. 8, 2015, 1 page.

* cited by examiner

ABRASIVE ARTICLE HAVING A CORE INCLUDING A POLYMER MATERIAL

CROSS-REFERENCE TO RELATED APPLICATION(S)

This application claims priority under 35 U.S.C. § 120 to and is a continuation of U.S. application Ser. No. 14/725,925, entitled "ABRASIVE ARTICLE HAVING A CORE INCLUDING A POLYMER MATERIAL," by Boris L. SEREBRENNIKOV, Debdutta ROY, John TUNSTALL, and Arup K. KHAUND, filed May 29, 2015, which in turn claims priority under 35 U.S.C. § 119(e) to U.S. Patent Application No. 62/004275 entitled "ABRASIVE ARTICLE HAVING A CORE INCLUDING A POLYMER MATERIAL," by Boris L. SEREBRENNIKOV, Debdutta ROY, John TUNSTALL, and Arup K. KHAUND, filed May 29, 2014, both of which are assigned to the current assignee hereof and incorporated herein by reference in their entireties.

FIELD OF THE DISCLOSURE

The present disclosure relates to an abrasive article and in particular to an abrasive article having a core including a polymer material.

BACKGROUND

The use of abrasive wheels to contour and/or chamfer the edge of a flat material, e.g., a sheet material made from glass or metal, is typically carried out for both safety and cosmetic reasons. Such abrasive wheels may include diamond-containing abrasive wheels and may be used to shape the edges of materials for various industries, including but not limited to automotive, architectural, furniture, and appliance industries. Certain prior art abrasive wheels are described in U.S. Pat. Nos. 3,830,020; 4,457,113; 6,769,964 and U.S. Publ. No. 20090017736. Commercial edge grinding wheels typically include a heavy metal core part and a profiled bonded abrasive disposed at the periphery of the metal core.

There are a number of unresolved issues associated with edge grinding tools and a need continues to exist for improved products.

SUMMARY

According to one aspect, an abrasive article comprises a bonded abrasive body disposed within an interior recess of a peripheral surface of a core, wherein the core comprises a polymer material and reinforcing fibers, and wherein the core has a heat deflection temperature (HDT) at 0.45 MPa of at least about 130° C. and a shrinkage ratio of not greater than 3%.

According to another aspect, an abrasive article comprises a bonded abrasive body disposed within an interior recess of a peripheral surface of a core, wherein the core comprises a polymer material and reinforcing fibers, the reinforcing fibers having an average aspect ratio of length to width ranging from at least 10 to not greater than 5000.

In yet another aspect, an abrasive article comprises a bonded abrasive body disposed within an interior recess of a peripheral surface of a core, wherein the core comprises a polymer material and further comprises an inner portion and an outer radial portion disposed circumferentially around the periphery of the inner portion, wherein the outer radial portion comprises a thickness ($T_{or}$) different than a thickness of the inner portion ($T_{ir}$).

In another aspect, a method of making an abrasive wheel comprises inserting a bonded abrasive body into a mold and injection molding a core around at least a portion of the bonded abrasive body to form an integrally bonded abrasive article, wherein the core comprises a polymer material and has an HDT at 0.45 MPa of at least 130° C. and a shrinkage ratio of not greater than 3%, and wherein the bonded abrasive body is disposed within an interior recess of a peripheral surface of the core.

BRIEF DESCRIPTION OF THE DRAWINGS

The present disclosure may be better understood, and its numerous features and advantages made apparent to those skilled in the art by referencing the accompanying drawings.

DETAILED DESCRIPTION

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

As used herein, and unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Various embodiments of the present disclosure will now be described, by way of example only, with reference to the accompanying drawings.

Figure 1:
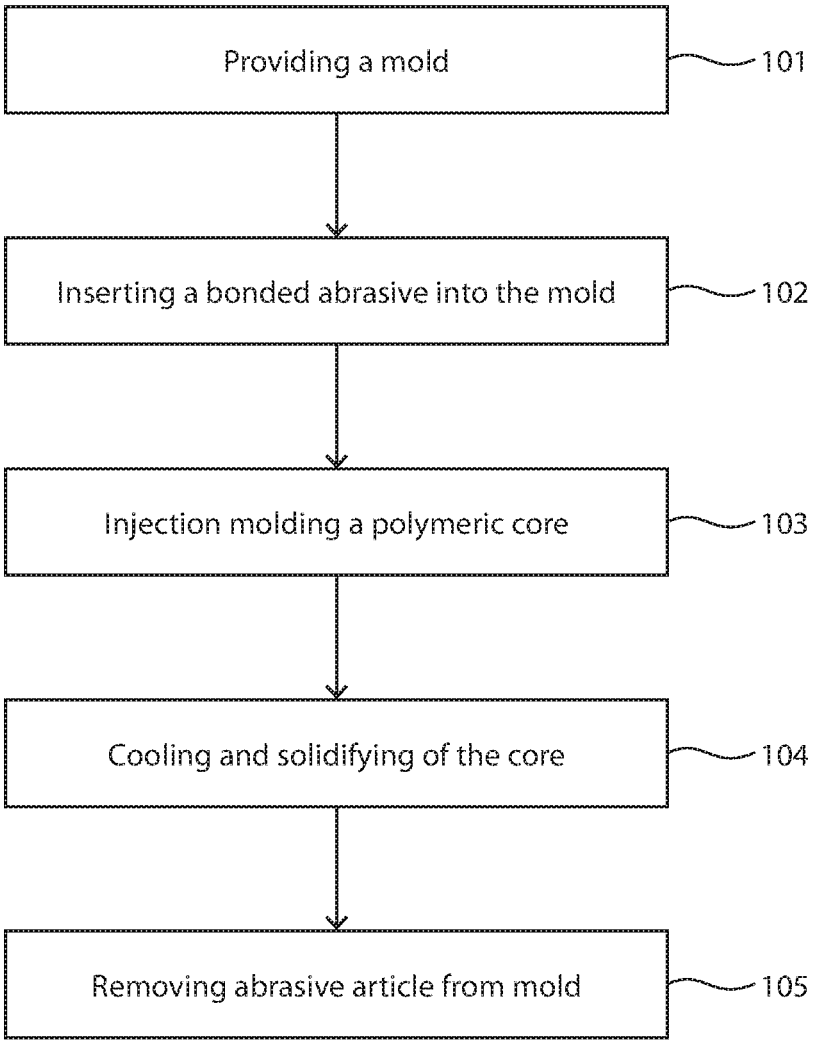
FIG. 1 includes a flow chart illustrating a method of making an abrasive article according to one embodiment.

According to one embodiment, as also shown in FIG. 1, the method of making an abrasive article of the present disclosure may include the following steps: 1) providing a mold 101; 2) inserting a bonded abrasive into the mold 102; 3) injection molding a core 103; 4) cooling and solidifying the core 104; and 5) removing the abrasive article from the mold 105.

The mold may be designed having an inner volume corresponding to the outer shape of the core for an abrasive wheel. The bonded abrasive body can be inserted into the mold, for example, near or at the periphery of the mold, such that during injection molding, the bonded abrasive body can be overmolded with the injected polymer material.

The injection molding temperature depends of the type of polymer material used for forming the core. Generally, the injection molding temperature can be at least about 25° C. to about 50° C. higher than the minimum temperature required to fill up the mold with melted polymer material. In an embodiment, the injection molding temperature can be at least 230° C., such as at least 250° C., or at least 280° C. In another embodiment, the injection molding temperature can be not greater than 400° C., such as not greater than 350° C. or not greater than 300° C. It will be appreciated that the injection molding temperature can be within a range between any of the minimum and maximum values noted above, such as from about 230° C. to about 380° C., from about 250° C. to about 350° C. or from about 280° C. to about 330° C.

After cooling and solidifying of the core, the bonded abrasive body may be disposed within an interior recess of a peripheral surface of the core.

In a further embodiment, the method of making an abrasive article may include adding a vibration damping layer between at least a portion of the core and at least a portion of the bonded abrasive body. The inclusion of the vibration damping layer may be completed before injection molding of the core to the bonded abrasive body. For example, a vibration damping layer may be partially or temporarily affixed to at least a portion of the bonded abrasive body. The bonded abrasive body and the vibration damping layer may be disposed in the mold. Thereafter, material may be injected into the mold to form the core and bond the core to the vibration damping layer and the bonded abrasive body.

Figure 2A:
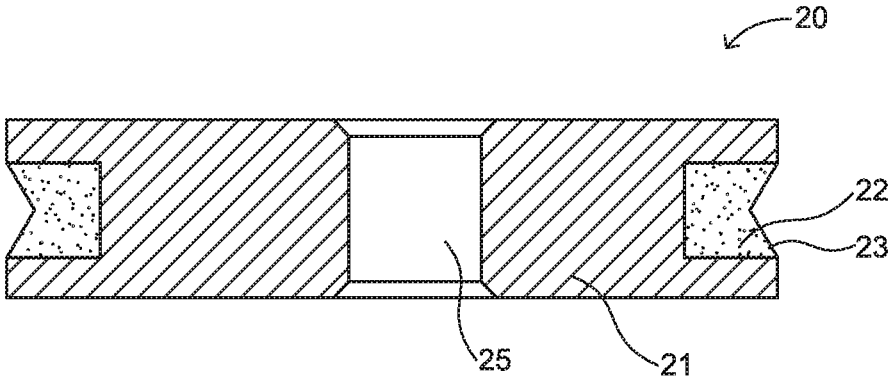
FIG. 2A includes a cross-sectional representation of an abrasive wheel according to one embodiment.
Figure 2B:
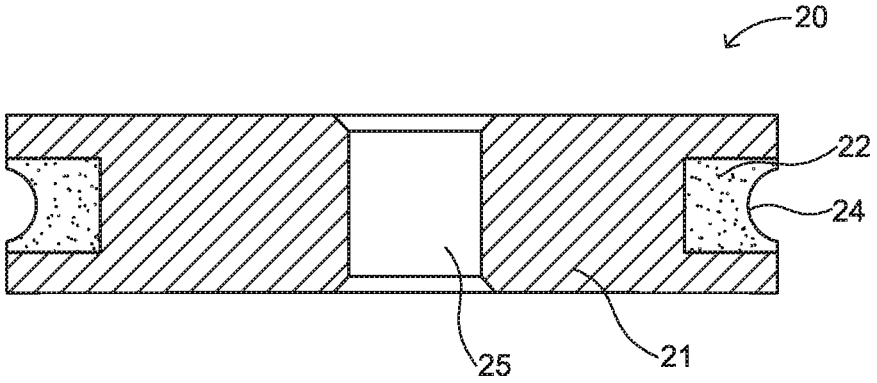
FIG. 2B includes a cross-sectional representation of an abrasive wheel according to one embodiment.

As demonstrated in the embodiments shown in FIGS. 2A and 2B, the abrasive article 20 formed by the above-described method comprises a core 21 comprising a polymer material and a bonded abrasive body 22. In one particular instance, the bonded abrasive body may be disposed within an interior recess of a peripheral surface of the core.

The core 21 may include a particular polymer material that facilitates improved performance of the bonded abrasive body, including but not limited to, aspects of strength, wearability, vibration damping, and manufacturability.

In one embodiment, the core of the abrasive article of the present disclosure may have a particular heat deflection temperature (HDT) at 0.45 MPa of at least about 130° C., such as at least about 140° C., at least about 150° C., at least about 160° C., at least about 180° C., at least about 200° C.; at least about 230° C., at least about 250° C., or at least about 260° C. In another non-limiting embodiment, the HDT of the core at 0.45 MPa may not be not greater than 400° C., such as not greater than 380° C., or not greater than 360° C. It will be appreciated that the HDT at 0.45 MPa of the core can be within a range between any of the minimum and maximum values noted above, such as from about 130° C. to about 400° C., from about 200° C. to about 350° C., or from about 250° C. to about 330° C.

In another embodiment, the core 21 of the abrasive article may have a shrinkage ratio of not greater than 3%, such as not greater than 2%, not greater than 1.5%, not 1.0%, not greater than 0.8%, not greater than 0.5%, not greater than 0.3%, not greater than 0.1%, or not greater than 0.05%. In a particular embodiment, the shrinkage ratio may be not greater than 0.1%.

In another embodiment, the shrinkage ratio of the core is at least 0.001% or at least 0.005%. It will be appreciated that the shrinkage ratio of the core can be within any of the minimum and maximum values noted above, such as from 0.001% to 3%, from 0.005% to 1%, or from 0.001% to 0.1%.

In a further embodiment, the core 21 of the abrasive article can have a Charpy impact of at least 45 $kJ/m^2$, such as at least 50 $kJ/m^2$, at least 55 $KJ/m^2$, at least 60 $kJ/^{m2}$, at least 80 $kJ/m^2$, at least 100 $kJ/m^2$, or at least 150 $kJ/m^2$; in another aspect, the Sharpy impact may be not greater than 300 $kJ/m^2$ or not greater than 250 $kJ/m^2$. It will be appreciated that the Charpy impact can be within a range from any of the minimum and maximum values noted above, such as from 45 $kJ/m^2$ to 300 $kJ/m^2$, from 50 $kJ/m^2$ to 250 $kJ/m^2$, or from 100 $KJ/m^2$ to 180 $kJ/m^2$.

In one embodiment the core 21 can include a polymer material selected from the group of a polyamide (PA), a polybutylene terephthalate (PBT), a polyphenylene sulfide (PPS), ethylene tetrafluoroethylene (ETFE), a polyetherketone (PEEK), a polyester (PE), a polyethyleneimine (PEI), a polyethersulfone (PESU), a polyethylene terephthalate (PET), a polyphthalamide (PPA), a poly (p-phenylene sulfide), a polycarbonate (PC), acrylonitrile-butadiene-styrene (ABS), PC-ABS, or any combination thereof. In an aspect, the polymer material may be a nylon, a PBT, a PPS, or a PC-ABS. The nylon may be, for example, nylon 6, nylon 66, nylon 610, nylon 612, nylon 66/6, nylon 410, or nylon 46. In a particular embodiment, the polymer material of the core may consist essentially of PPS. In another particular embodiment, the polymer material of the core may consist essentially of PC-ABS. In another embodiment, the polymer material of the core may be essentially free of nylon.

In another embodiment, the core 21 may further contain reinforcing fibers and/or a powder distributed within the polymer material. The reinforcing fibers may include, for example, glass fibers, carbon fibers, ceramic fibers, organic fibers, mineral fibers, or combinations thereof. Suitable powders may be, for example, calcium carbonate, glass powder, mineral powder, or talc.

In a particular embodiment, the reinforcing fibers of the core may consist essentially of carbon fibers. In another particular embodiment, the reinforcing fibers of the core can consist essentially of glass fibers. Under consisting essentially should be understood only one specific type of fibers containing only unavoidable impurities.

The amount of reinforcing fibers and/or powder contained in the core may be at least about 1 wt %, such as at least about 5 wt %, at least about 10 wt %, at least about 15 wt %, at least about 20 wt %, at least about 25 wt %, or at least about 30 wt %, based on the total weight of the core. In another aspect, the amount of reinforcing fibers and/or powder may be not greater than 60 wt %, such as not greater than 55 wt %, not greater than 50 wt %, not greater than 45 wt %, or not greater than 40 wt %. It will be appreciated that the amount of reinforcing fibers and/or powder contained in the core can be within a range between any of the minimum and maximum values noted above, such as from about 5 wt to about 50 wt %, from about 15 wt % to about 40 wt %, from about 20 wt % to about 50 wt %, or from about 30 wt % to about 50 wt % based on the total weight of the core.

In one embodiment, the reinforcing fibers can have an average aspect ratio of length to width of at least about 3, such as at least about 5, at least about 10, at least about 30, at least about 50, at least about 100, at least about 500, or at least about 800. In another embodiment the primary aspect ratio of the reinforcing fibers may be not greater than 5000, such as not greater than 3500, not greater than 2000, not greater than 1200, not greater than 1100, or not greater than 1000. It will be appreciated that the average aspect ratio of the reinforcing fibers can be within a range between any of the minimum and maximum values note above, such as from about 3 to about 5000, from about 3 to about 1300, from about 10 to about 1200, from about 100 to about 1200, from about 500 to about 1200, from about 700 to 1200, or from about 800 to about 1200.

In one embodiment, the core of the abrasive article of the present disclosure may consist essentially of the polymer material and the reinforcing fibers, the reinforcing fibers being present in an amount of 30 to 50 wt % based on the total weight of the core and having an average aspect ratio of length to width of 500 to 1200.

In a particular embodiment, the core may comprise PPS and carbon fibers, the carbon fibers having an average aspect ratio from about 800 to about 1200, wherein the core can have a shrinkage ratio of not greater than 0.1% and a tensile modulus of at least about 20.0 GPa.

In another particular embodiment, the core can comprise PC-ABS and glass fibers, the glass fibers having an average aspect ratio from about 800 to about 1200, wherein the core can have a shrinkage ratio of not greater than 0.1% and a tensile modulus of at least about 20.0 GPa.

According to one embodiment, the core 21 of the abrasive article can represent a majority of the total volume of the abrasive article. For example, in one embodiment, the core can be at least about 60 vol % based on the total volume of the abrasive article, such as at least about 70 vol %, at least about 75 vol %, at least 80 vol % or at least 85 vol %. Still, in another non-limiting embodiment, the core may be not greater than about 99 vol % of the abrasive article, such as at not greater than about 97 vol %, not greater than about 95 vol %, or not greater than about 90 vol %. It will be appreciated that the volume percentage of the core of the abrasive article based on the total volume of the abrasive article can be within a range between any of the minimum and maximum values noted above, such as from about 65 vol % to about 99 vol %, from about 70° vol % to about 95 vol %, or from about 80 vol % to about 95 vol %.

The bonded abrasive body 22 can be disposed in a recess at the peripheral surface of the core 21 and can include abrasive particles fixed in a bond material. Suitable abrasive particles can include, for example, oxides, carbides, nitrides, borides, diamond, cubic boron nitride, silicon carbide, boron carbide, alumina, silicon nitride, tungsten carbide, zirconia, or a combination thereof. In a particular aspect, the abrasive particles of the bonded abrasive are diamond particles. In at least one embodiment, the abrasive particles can consist essentially of diamond.

The abrasive particles contained in the bonded abrasive body can have an average particle size suitable to facilitate particular grinding performance. For example, the abrasive particles can have a size less than about 2000 μm, such as less than about 1000 μm, less than about 500 μm, or less than about 300 μm. In another aspect, the abrasive particles can have a size of at least 0.01 μm, such as at least 0.1 μm, at least about 1 μm, at least 5 μm or at least 10 μm. It will be appreciated that the size of the abrasive particles contained in the bonded abrasive can be within a range between any of the minimum and maximum values noted above, such as from about 0.01 μm to about 2000 μm, from about 1 μm to about 500 μm, from about 5 μm to about 300 μm or from about 50 μm to about 150 μm.

The bond material of the bonded abrasive body can include an inorganic material, an organic material, and a combination thereof. Suitable inorganic materials for the use as bond material may include metals, glass, glass-ceramics, and a combination thereof. For example, an inorganic bond material can include one or more metal compositions or elements such as Cu, Sn, Fe, W, WC, Co, and a combination thereof. Organic materials may include resins, for example thermosets, thermoplastics, and a combination thereof. For example, some suitable resins can include phenolic resins, epoxies, polyesters, cyanate esters, shellacs, polyurethanes, rubber, polyimides and a combination thereof.

As also shown in the embodiments of FIGS. 2A and 2B, the bonded abrasive body 22 may include a V-shape 23 or U-shape 24 profile ground therein, which will be reproduced on the material to be shaped.

The abrasive article of the present disclosure may be selected from a range of suitable sizes to facilitate efficient grinding depending upon the workpiece. In one embodiment, the abrasive article can include an abrasive wheel having a diameter of at least about 25 mm, such as at least about 30 mm or at least about 50 mm. In another embodiment, the wheel diameter may be not greater than 500 mm, such as not greater than 450 mm, not greater than 300 mm or not greater than 200 mm. It will be appreciated that the wheel diameter can be within a range between any of the minimum and maximum values noted above, such as from about 25 mm to about 500 mm, from about 50 mm to about 250 mm, or from about 25 mm to about 150 mm.

In an embodiment, the abrasive article of the present disclosure may include a vibration damping layer disposed between at least a portion of the core and a portion of the bonded abrasive body.

Figure 3A:
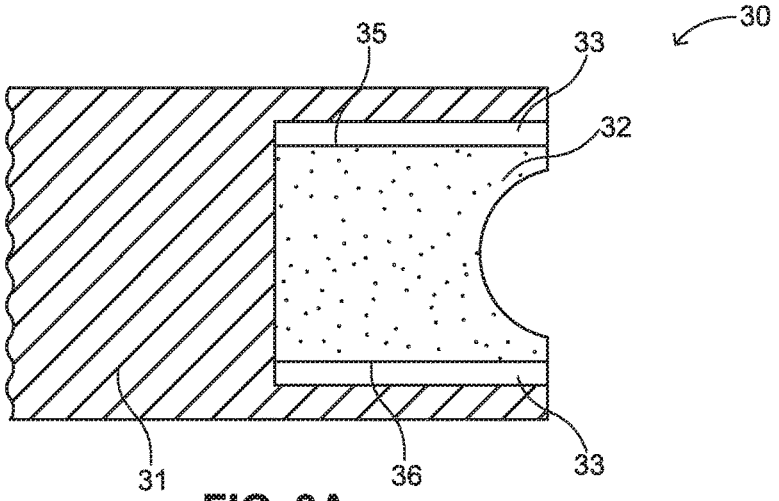
FIG. 3A includes a cross-sectional representation of an abrasive wheel including a vibration damping layer according to one embodiment.

FIG. 3A shows an embodiment, wherein the vibration damping layer 33 is contained on the top surface 35 and on the bottom surface 36 of the bonded abrasive body 32 in the recess of the core 31, and wherein the vibration damping layer 33 extends over the entire length of the top surface 35 and the bottom surface 36 of the bonded abrasive body.

Figure 3B:
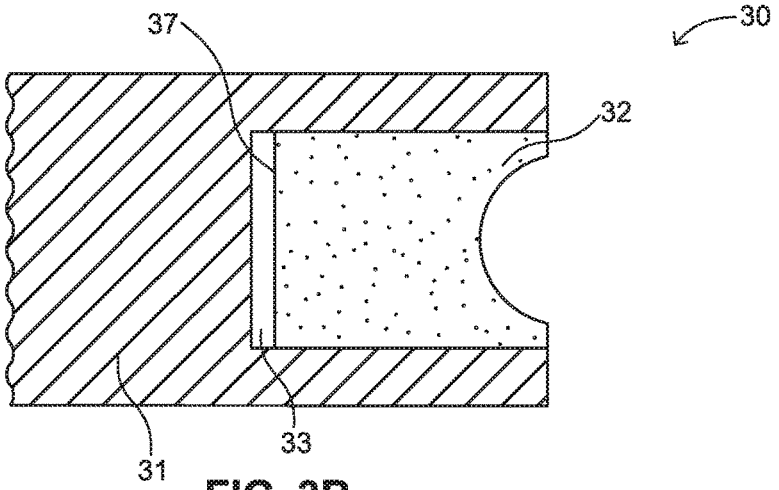
FIG. 3B includes a cross-sectional representation of an abrasive wheel including a vibration damping layer according to another embodiment.

FIG. 3B demonstrates an embodiment wherein the vibration damping layer is contained behind the bonded abrasive body 32, on the side surface 37 of the abrasive body in the recess of the core 31, extending over the entire side surface 37 of the bonded abrasive body.

Figure 3C:
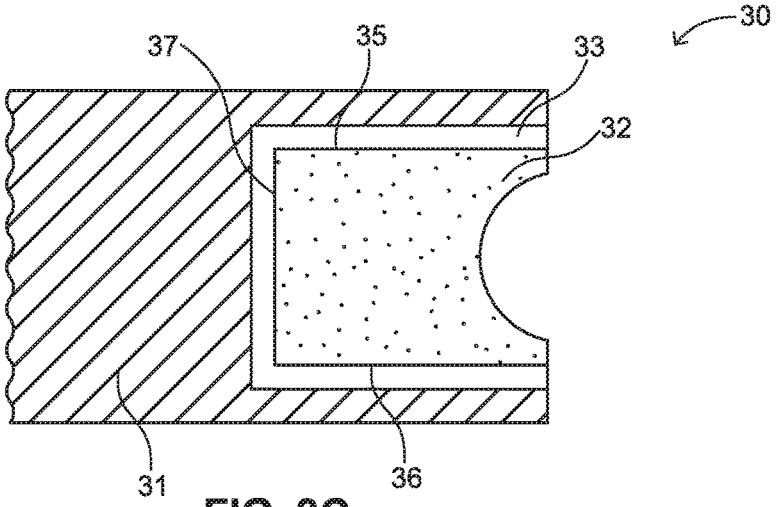
FIG. 3C includes a cross-sectional representation of an abrasive wheel including a vibration damping layer according to a further embodiment.

As further shown in FIG. 3C, the vibration damping layer 33 can also be contained on the side surface 37 as well as on the top and bottom surfaces 35, 36 of the bonded abrasive body in the recess of the core 31. In the embodiment of FIG. 3C, the vibration damping layer extends over the entire top surface 35, the entire bottom surface 36, and the entire side surface 37 of the bonded abrasive body.

In one aspect, the vibration damping layer 33 may include a material suitable for damping vibrations that are generated at the bonded abrasive body 32 during grinding operation of the abrasive article 30. In at least one embodiment, the vibration damping layer 33 may further facilitate manufacturing of the abrasive article and facilitate joining of the bonded abrasive body 32 to the core 31 during the forming process. In one particular embodiment, the vibration damping layer 33 may include a polymer material. Some suitable examples of polymer materials can include a thermoplastic rubber or thermoset rubber of a thermoplastic elastomer. For example, the vibration damping layer 33 may include silicone, a polyurethane, a styrene butadiene (SBR), or combinations thereof. In a particular aspect, the vibration damping layer 33 may consist essentially of silicone.

In another aspect, the vibration damping layer 33 may have a tensile modulus of at least about 50 MPa, such as at least about 60 MPa, at least about 80 MPa, or at least about 100 MPa. In a further aspect, the tensile modulus may be not greater than about 200 MPa, such as not greater than about 180 MPa or not greater than about 150 MPa. It will be appreciated that the tensile modulus can be within a range between any of the minimum and maximum values noted above, such as from about 50 MPa to about 200 MPa, from about 60 MPa to about 170 MPa, or from about 100 MPa to about 150 MPa.

In a further aspect, the vibration damping layer 33 can have a compressive modulus (CM) of at least 0.2 MPa, such as at least 0.5 MPa or at least 2 MPa. In yet another aspect, the CM of the vibration damping layer may be not greater than about 10 MPa, such as not greater than about 8 MPa, or not greater than about 7 MPa. It will be appreciated that the CM can be within a range between any of the minimum and maximum values noted above, such as from about 0.2 MPa to about 9 MPa or from about 0.3 MPa to about 5 MPa.

In another embodiment, the vibration damping layer can have a suitable thickness to facilitate improved performance. For example, the thickness of the vibration damping layer may be at least about 0.0.05 mm, such as at least about 0.2 mm, or at least about 0.3 mm. In yet another embodiment, the thickness of the vibration damping layer may not be greater than 2.0 mm, such as not greater than 1.6 mm, or not greater than 1.3 mm. It will be appreciated that the thickness of the vibration damping layer can be within a range between any of the minimum and maximum values noted above, such as from about 0.1 mm to about 2.0 mm, from about 0.2 to about 1.5 mm, or from about 0.3 mm to about 1.0 mm.

In yet another aspect, the thickness of the vibration damping layer may be reduced by at least 3% at a pressure of at least about 10 MPa, based on the thickness of the vibration damping layer at 0.1 MPa.

The core and the bonded abrasive body can be directly or indirectly coupled together. In one embodiment, the core and the bonded abrasive body can be joined together by friction, which may not necessarily include cohesive bonding or mechanical fasteners. In another aspect, the bonded abrasive body may be attached to the core with an adhesive. In a further embodiment, the bonded abrasive body and the core may comprise a coupling connection, which may be in the form of a mechanical interlock.

Figure 4:
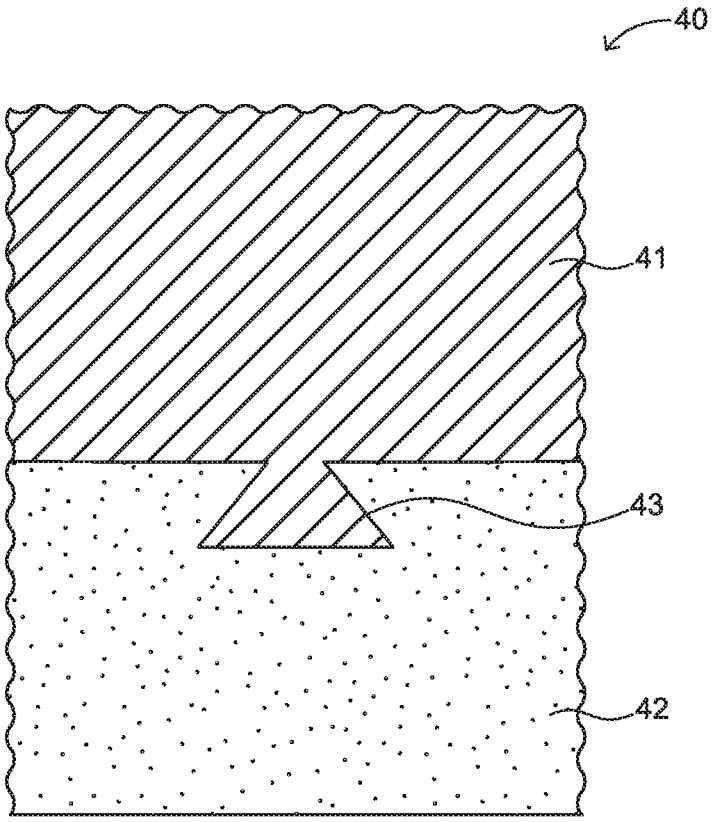
FIG. 4 includes an illustration of a coupling connection between a core and a bonded abrasive body according to one embodiment.

Referring to FIG. 4, an embodiment is demonstrated showing a cross-section of a coupling connection between the core 41 and the bonded abrasive body 42 in form of a mechanical interlock. The mechanical interlock may be formed, for example, during injection molding of the core by filling tapered channels 43 provided on the surface of the bonded abrasive body 42 with the melted polymer-based material. After solidifying of the core 41, a dovetail-type fastener structure can be established.

In another embodiment, one or more surfaces of the bonded abrasive body may have surface texture to facilitate improved coupling between the bonded abrasive body and the core. For example, the one or more surfaces of the bonded abrasive body may be roughened by brushing or sandblasting, or a mechanical structuring can be applied, e.g., by embossing of a honey comb structure.

Figure 5:
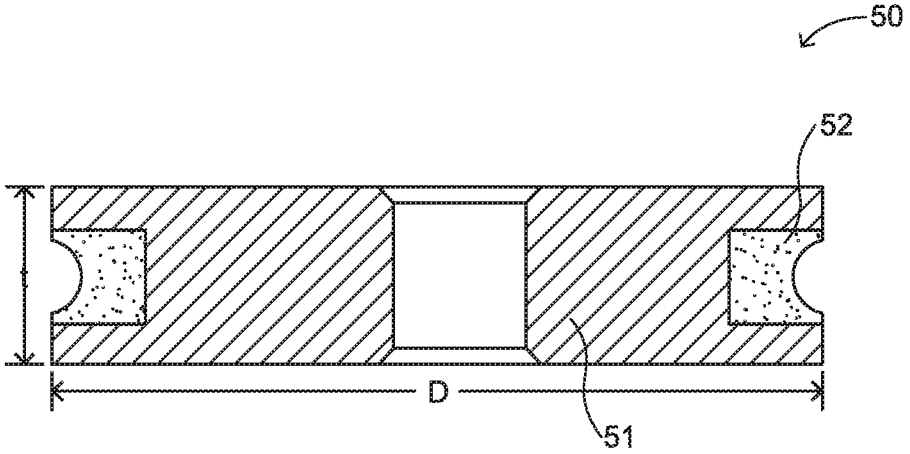
FIG. 5 includes a cross-sectional representation of an abrasive wheel according to one embodiment illustrating a diameter (D) of the core and a maximum thickness (t) of the core.

In one embodiment, as demonstrated in the cross-sectional view of FIG. 5, the abrasive article 50 may have a particular ratio of outer diameter (D) of the core 51 to the maximum thickness (t) of the core 51 that may facilitate manufacturing and performance of the abrasive article 50. For example, in one aspect, the abrasive article may have a ratio (D:t) of at least about 10:1, such as at least about 12:1 or at least about 15:1. In another aspect, the ratio (D:t) may be not greater than about 30:1, such as not greater than about 25:1, or not grater than about 20:1. It will be appreciated that the ratio of core diameter (D) to maximum core thickness (t) may be within a range between any of the minimum and maximum values noted above, such as from about 35:1 to about 10:1, from about 20:1 to about 10:1, or from about 15:1 to about 10:1.

Figure 6A:
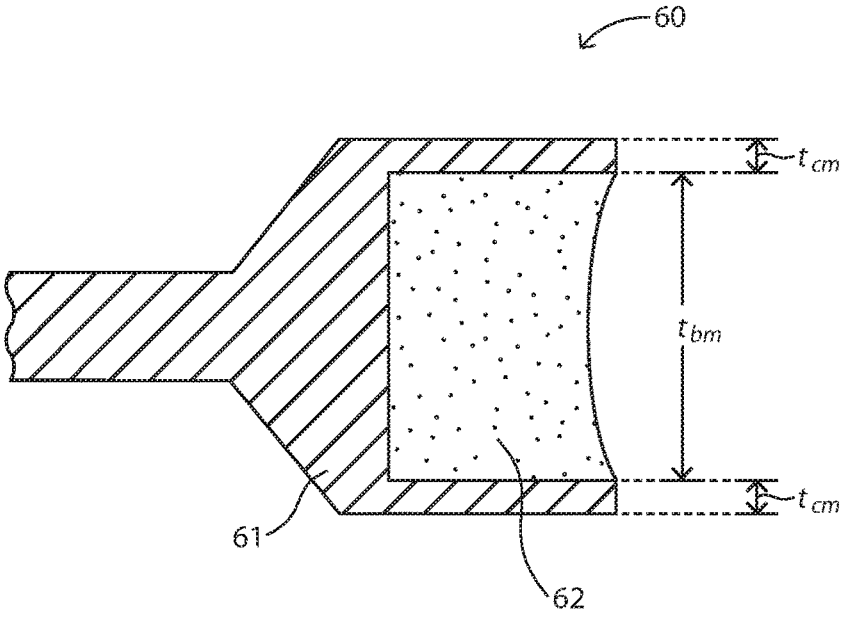
FIG. 6A includes a cross-sectional representation of a section of an abrasive wheel illustrating a maximum thickness of the bonded abrasive body $T_{bm}$ and a maximum thickness of the core $T_{cm}$ according to one embodiment.
Figure 6B:
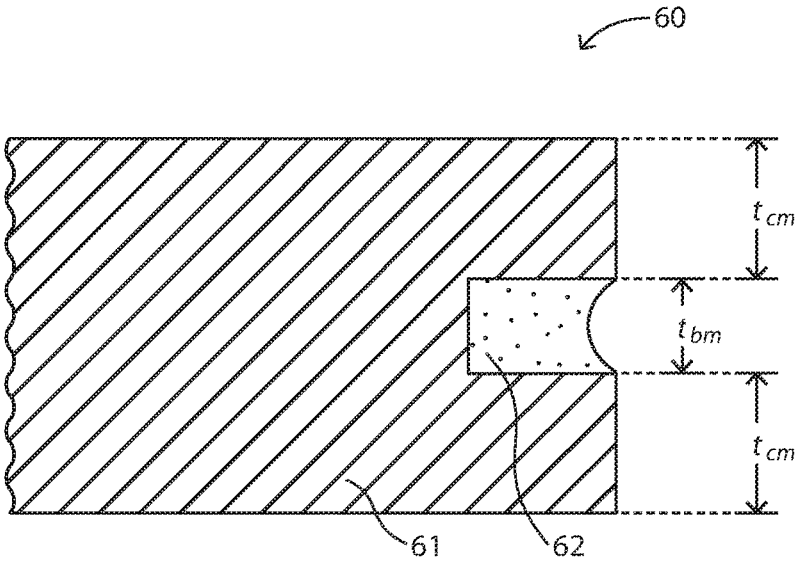
FIG. 6B includes a cross-sectional representation of a section of an abrasive wheel illustrating a maximum thickness of the bonded abrasive body $T_{bm}$ and a maximum thickness of the core $T_{cm}$ according to one embodiment.

In another embodiment, as demonstrated in FIGS. 6A and 6B, the abrasive article may have a particular ratio of a maximum thickness ($t_{bm}$,) of the bonded abrasive body 62 to a maximum thickness ($t_{cm}$) of the core 61 next to top and bottom surface of the bonded abrasive body. In one aspect, the ratio ($t_{bm}$:$t_{cm}$) is at least about 1:2, such as at least about 1:1.5 or at least about 1:1. In another aspect, the ratio ($t_{bm}$e:$t_{cl}$) may be not greater than about 5:1, such as not greater than about 3:1, or not greater than about 2:1. It will be appreciated that the ratio of maximum thickness of the bonded abrasive body to the lowest thickness of the core may be within a range between any of the minimum and maximum values noted above, such as from about 1:2 to about 5:1, from about 1:1 to about 3:1, or from about 1:1 to about 2:1.

Figure 7:
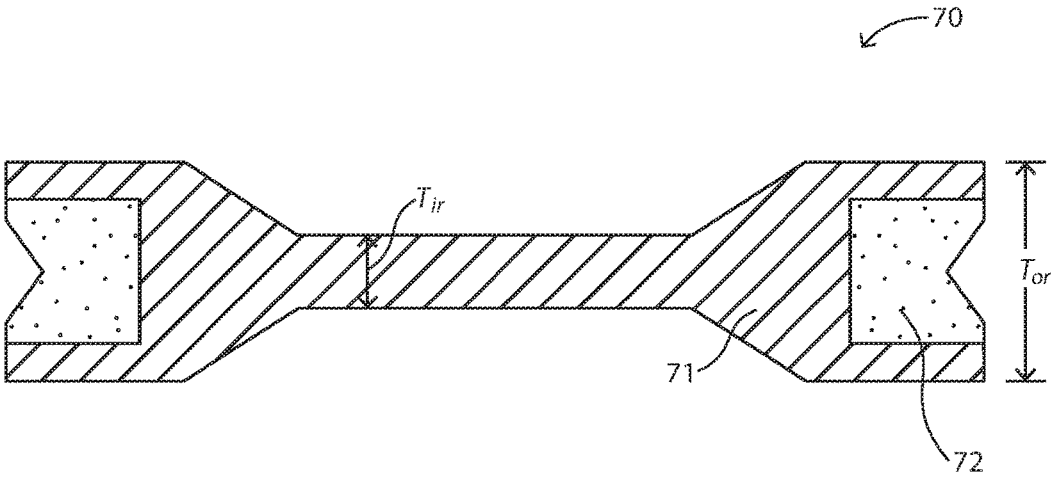
FIG. 7 includes a cross-sectional representation of an abrasive wheel illustrating a thickness of the outer radial portion ($T_{or}$) and a thickness of the inner portion ($T_{ir}$) according to one embodiment.

In a further embodiment, as demonstrated in FIG. 7, the abrasive article of the present disclosure may comprise a core 71 having an inner portion and an outer radial portion disposed circumferentially around the periphery of the inner portion, wherein the outer radial portion comprises a thickness ($T_{or}$) different than a thickness of the inner portion ($T_{ir}$). In one embodiment, a ratio ($T_{or}$:$T_{ir}$) of the thickness of the outer radial portion ($T_{or}$) to a thickness of the inner portion ($T_{ir}$) may be at least about 1.5:1, such as at least about 2:1 or at least about 3:1. In another embodiment, the ratio $T_{or}$:$T_{ir}$ may be not greater than about 10:1, such as not greater than about 8:1 or not greater than about 6:1. It will be appreciated that the ratio of $T_{or}$:$T_{ir}$ may be within a range between any of the minimum and maximum values noted above, such as from about 1.5:1 to about 10:1, from about 2:1 to about 8:1, or from about 6:1 to about 2:1.

Figure 8:
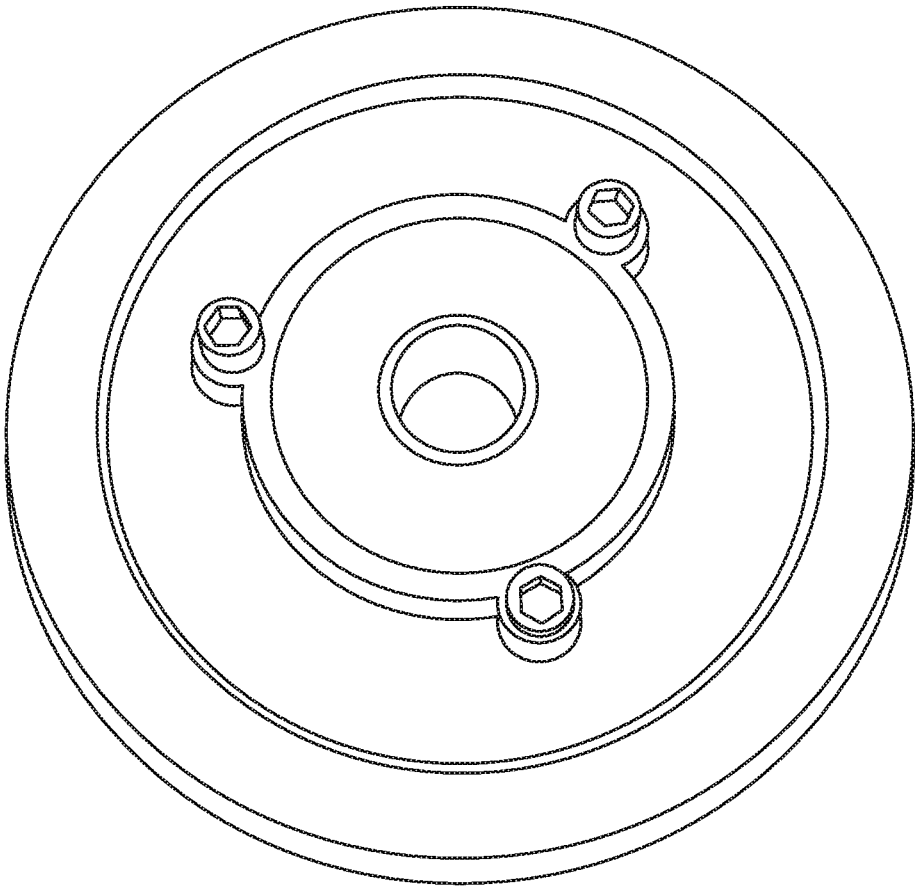
FIG. 8 includes a photo illustrating an injection molded core mounted on a steel test hub according to one embodiment.

FIG. 8 shows a photo of an injection molded grinding wheel mounted on a steel test hub according to one embodiment.

The abrasive article of the present disclosure can be designed for shaping the edges of a workpiece. The workpiece can be an inorganic or organic material, such as, for example, glass, plastic, ceramic, or metal. In a particular embodiment, the workpiece can include glass, including but not limited to automotive glass, architectural glass, furniture glass, optical glass, and glass used in displays and/or to cover electronic devices (e.g., a phone). The workpiece can further be crystalline, such as monocrystalline or polycrystalline, including but not limited to sapphire.

In a particular embodiment, the abrasive article of the present disclosure can be an abrasive wheel. In one aspect, the burst strength of the abrasive wheel may be at least 135 m/s, such as at least 150 m/s, at least 160 m/s or at least 180 m/s. In another embodiment, the burst strength may be not larger than 300 m/s m/s, such as not larger than 280 m/s, or not larger than 250 m/s.

In another aspect, the abrasive wheel may be designed that it can be mechanically fastened to an arbor. In a aspect, the arbor may be an integral part of the core and being formed together with the core during injection molding.

It has been surprisingly found that certain polymer-based materials are suitable for use as a core according to the embodiments herein. Accordingly, a light weight abrasive wheel suitable for edge grinding can be formed having high mechanical strength and wearability. Moreover, the process of making the abrasive articles of the embodiments herein has proven benefits in terms of manufacturing efficiency.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

ITEMS

Item 1. An abrasive article, comprising a bonded abrasive body disposed within an interior recess of a peripheral surface of a core, wherein the core comprises a polymer material and the core has an HDT at 0.45 MPa of at least about 130° C.

Item 2. An abrasive article, comprising a bonded abrasive body disposed within an interior recess of a peripheral surface of a core, wherein the core comprises a polymer material and the core has a shrinkage ratio of not greater than about 3%.

Item 3. An abrasive article, comprising a bonded abrasive body disposed within an interior recess of a peripheral surface of a core, wherein the core comprises a polymer material and further comprises an inner portion and an outer radial portion disposed circumferentially around the periphery of the inner portion, wherein the outer radial portion comprises a thickness ($T_{or}$) different than a thickness of the inner portion ($T_{ir}$).

Item 4. An abrasive article, comprising a bonded abrasive body disposed within an interior recess of a peripheral surface of a core, wherein the core comprises a polymer material and the core has a tensile modulus of at least about 4 GPa.

Item 5. The abrasive article of item 4, wherein the tensile modulus of the core is at least about 5 GPa, such as at least about 10 GPa, at least about 15 GPa, at least about 18 GPa, or at least about 20 GPa.

Item 6. The abrasive article of item 1, wherein the core has an HDT at 0.45 MPa of at least about 140° C., such as at least about 150° C., at least about 160° C., at least about 170° C., at least about 180° C., at least about 190° C., at least about 200° C., at least 250° C. or at least 260° C.

Item 7. The abrasive article of item 2, wherein the core has a shrinkage ratio of not greater than 2.5%, such as not greater than about 2.0%, not greater than about 1.5%, not greater than about 1.0%, not greater than about 0.8%, not greater than about 0.5%, not greater than about 0.3%, not greater than 0.1% or not greater than 0.05%.

Item 8: The abrasive article of any of the preceding items, wherein the core has a Sharpy impact of at least 45 kJ/m$^2$, at least 50 kJ/m$^2$, at least 60 kJ/m$^2$, at least 80 kJ/m$^2$, or at least 100 kJ/m$^2$, or at least 150 kJ/m$^2$.

Item 9. The abrasive article of any of items 1 to 8, wherein the Sharpy impact is not greater than 300 kJ/m$^2$, or not greater than 250 kJ/m$^2$.

Item 10. The abrasive article of item 3, wherein a ratio of the thickness of the outer radial portion ($T_{or}$) to a thickness of the inner portion ($T_H$) is from about 1:1 to about 10:1, such as from about 1:1 to about 8:1, or from about 1:1 to about 5:1.

Item 11. The abrasive article of any one of the preceding items, wherein the polymer material includes at least one of a polyamide (PA), a polybutylene terephthalate (PBT), a polyphenylene sulfide (PPS), ethylene tetrafluoroethylene (ETFE), a polyetherketone (PEEK), a polyester (PE), a polyethyleneimine (PEI), a polyethersulfone (PESU), a polyethylene terephthalate (PET), a polyphthalamide (PPA), a poly (p-phenylene sulfide), polycarbonate (PC), acrylonitrile-butadiene-styrene (ABS), PC-ABS, or any combination thereof.

Item 12. The abrasive article of item 11, wherein the polymer material includes PPS or PC-ABS.

Item 13. The abrasive article of any one of the preceding items, wherein the core further comprises reinforcing fibers and/or a powder.

Item 14. The abrasive article of item 13, wherein the amount of reinforcing fibers and/or powder ranges from about 5 wt % to about 50 wt % based on the total weight of the core.

Item 15. The abrasive article of items 13 or 14, wherein the reinforcing fibers include glass fibers, carbon fibers, ceramic fibers, organic fibers, mineral fibers, or combinations thereof.

Item 16: The abrasive article of items 13 to 15, wherein the reinforcing fibers have an average aspect ratio of at least 3, such as at least 6, at least 10, at least 100, at least 500, at least 700, at least 800, at least 1000, at least 1200, or at least 1500.

Item 17. The abrasive article of items 13 to 15, wherein the reinforcing fibers have an average aspect ratio of not greater than 5000, such as not greater than 3000, or not greater than 1500.

Item 18. The abrasive article of any of item 13, wherein the powder includes at least one of calcium carbonate, talc, or a mineral powder.

Item 19. The abrasive article of any one of items 13 to 17, wherein the core consists essentially of polyphenylene sulfide (PPS) and carbon fibers.

Item 20. The abrasive article of any of items 13 to 17, wherein the core consists essentially of PC-ABS and glass fibers.

Item 21. The abrasive article of any of the preceding items wherein the bonded abrasive body comprises abrasive particles including diamond, cubic boron nitride, silicon carbide, boron carbide, alumina, silicon nitride, tungsten carbide, zirconia, or a combination thereof.

Item 22. The abrasive article of item 21, wherein the abrasive particles comprise diamond.

Item 23. The abrasive article of any of the preceding items, wherein a bond material of the bonded abrasive body includes Cu, Sn, Fe, W, WC, Co, Ti or any combination thereof.

Item 24. The abrasive article of any of the preceding items, wherein the core provides a volume amount of at least about 60 vol % and not greater than about 99 vol %, such as at least about 70 vol % and not greater than about 95 wt %, or at least about 80 vol % and not greater than 95 wt % based on the total volume amount of the core and the bonded abrasive body.

Item 25. The abrasive article of any one of the preceding items, wherein a ratio of a maximum diameter of the core to a maximum thickness of the core is between about 30:1 to about 10:1.

Item 26. The abrasive article of any one of the preceding items, wherein a ratio of a maximum thickness of the bonded abrasive body to a maximum thickness of the core is between about 5:1 to about 1:5.

Item 27. The abrasive article of any one of the preceding items, wherein the core is in direct contact with the bonded abrasive body.

Item 28. The abrasive article of any one of the preceding items, further comprising a vibration damping layer disposed between at least a portion of the core and a portion of the bonded abrasive body.

Item 29. The abrasive article of item 28, wherein the vibration damping layer comprises a polymer material.

Item 30. The abrasive article of item 29, wherein the polymer material of the vibration damping layer includes silicone, a thermoplastic or a thermoset rubber, a thermoplastic elastomer, a polyurethane, or a combination thereof.

Item 31. The abrasive article of item 30, wherein the polymer material comprises silicone.

Item 32. The abrasive article of item 31, wherein the vibration damping layer consists essentially of silicone.

Item 33. The abrasive article of any of items 28 to 32, wherein the vibration damping layer has a tensile modulus of at least 50.

Item 34. The abrasive article of any of items 28 to 33, wherein the vibration damping layer has a compressive modulus of at least 0.2 MPa.

Item 35. The abrasive article of any one of items 28 to 34, wherein a thickness of the vibration damping layer is reduced by at least 3% at a pressure of at least 10 MPa , based on a thickness of the vibration damping layer at 0.1 MPa.

Item 36. The abrasive article of any one of items 1 to 35, further comprising a coupling connection between the core and the bonded abrasive body.

Item 37. The abrasive article of item 36, wherein the coupling connection is a mechanical interlock having a dovetail structure.

Item 38. The abrasive article of any one of the preceding items, wherein the article is an abrasive wheel.

Item 39. The abrasive wheel of item 38, wherein the abrasive wheel has a burst strength of at least 140 m/s, such as at least 145 m/s, at least 150 m/s, 160 m/s, or at least 180 m/s.

Item 40. The abrasive wheel of items 38 or 39, wherein the abrasive wheel is configured for shaping a workpiece comprising glass, such as a glass display or a cover for an electronic device, architectural glass, furniture glass, optical glass, or automotive glass.

Item 41. A method of making an abrasive wheel, comprising inserting a bonded abrasive body into a mold; and injection molding a core around at least a portion of the bonded abrasive body to form an integrally bonded abrasive article, wherein the core comprises a polymer material and has an HDT at 0.45 MPa of at least 130° C. and a shrinkage ratio of at least 3%; and the bonded abrasive body is disposed within an interior recess of a peripheral surface of the core.

Item 42. The method of item 41, wherein the polymer material includes at least one a polyamide (PA), a polybutylene terephthalate (PBT), a polyphenylene sulfide (PPS), ethylene tetrafluoroethylene (ETFE), a polyetherketone (PEEK), a polyester (PE), a polyethyleneimine (PEI), a polyethersulfone (PESU), a polyethylene terephthalate (PET), a polyphthalamide (PPA), a poly (p-phenylene sulfide), polycarbonate (PC), acrylonitrile-butadiene-styrene (ABS), PC-ABS, or any combination thereof.

Item 43. The method of item 42, wherein the polymer material includes PPS or PC-ABS.

Item 44. The method of any of items 41, 42, or 43, wherein the polymer material comprises reinforcing fibers or a powder.

Item 45. The method of item 44, wherein the amount of the reinforcing fibers ranges from about 5 wt % to about 50 wt % based on the total weight of the polymer material.

Item 46. The method of items 44 or 45, wherein the reinforcing fibers include glass fibers, carbon fibers, ceramic fibers, organic fibers, mineral fibers or any combination thereof.

Item 47. The method of any one of items 41 to 46, wherein the bonded abrasive body comprises abrasive particles selected from the group consisting of diamond, cubic boron nitride, silicon carbide, boron carbide, alumina, silicon nitride, tungsten carbide, zirconia, and combinations thereof.

Item 48. The method of item 47, wherein the abrasive particles comprise diamond particles.

Item 49. The method of any one of items 41 to 48, wherein the core is in direct contact with the bonded abrasive body.

Item 50. The method of any one of items 41 to 49, further comprising adding a vibration damping layer disposed between at least a portion of the bonded abrasive body and at least a portion of the core before the injection molding.

Item 51. The method of item 50, wherein the vibration damping layer includes a thermoplastic rubber, a thermoset rubber, a thermoplastic elastomer, a polyurethane or a combination thereof.

Item 52. The method of item 51, wherein the vibration damping layer consists essentially of silicone.

Item 53. The method of any one of items 50 to 52, wherein the vibration damping layer has a modulus of tensile modulus of at least 50 MPa.

Item 54. The method of any one of items 50 to 53, wherein the vibration damping layer has a compressive modulus (CM) of at least 0.2 MPa.

Item 55. An abrasive article, comprising:

a bonded abrasive body disposed within an interior recess of a peripheral surface of a core, wherein the core comprises a polymer material and reinforcing fibers, the reinforcing fibers having an aspect ratio of length to width ranging from at least 10 to not greater than 5000.

Item 56. The abrasive article of item 55, wherein the aspect ratio of the reinforcing fibers ranges from 100 to 1200.

Item 57. The abrasive article of items 55 or 56, wherein the core has an HDT at 0.45 MPa of at least 130° C.

Item 58. The abrasive article of item 57, wherein the HDT of the core at 0.45 MPa is at least 260° C.

Item 59. The abrasive article of any of items 55-57, wherein the core has a shrinkage ratio of not greater than about 3%.

Item 60. The abrasive article of item 59, wherein the shrinkage ratio of the core is not greater than about 0.1%.

Item 61. The abrasive article of any of items 55-60, wherein the core has a tensile modulus of at least about 4.0 GPa.

Item 62. The abrasive article of item 61, wherein the tensile modulus of the core is at least about 20 GPa.

Item 63. The abrasive article of any of items 55-62, wherein a ratio of the thickness of the outer radial portion (Tor) to a thickness of the inner portion (Tir) is from about 1:1 to about 10:1, such as from about 1:1 to about 8:1, or from about 1:1 to about 5:1.

Item 64. The abrasive article of any of items 55-63, wherein the polymer material includes at least one of a polyamide (PA), a polybutylene terephthalate (PBT), a polyphenylene sulfide (PPS), ethylene tetrafluoroethylene (ETFE), a polyetherketone (PEEK), a polyester (PE), a polyethyleneimine (PEI), a polyethersulfone (PESU), a polyethylene terephthalate (PET), a polyphthalamide (PPA), a poly (p-phenylene sulfide), polycarbonate (PC), acrylonitrile-butadiene-styrene (ABS), PC-ABS, or a combination thereof.

Item 65. The abrasive article of any of items 55-64, wherein the reinforcing fibers include glass fibers, carbon fibers, ceramic fibers, organic fibers, mineral fibers, or combinations thereof.

Item 66. The abrasive article of item 65, wherein the reinforcing fibers comprise glass fibers.

Item 67. The abrasive article of item 65, wherein the reinforcing fibers comprise carbon fibers.

Item 68. The abrasive article of any of items 55-67, wherein the amount of reinforcing fibers ranges from about 5 wt % to about 50 wt % based on the total weight of the core.

Item 69. The abrasive article of item 55, wherein the core comprises PPS and carbon fibers and a shrinkage ratio of the core is not greater than 0.1%.

Item 70. The abrasive article of item 55, wherein the core comprises PC-ABS and glass fibers and a shrinkage ratio of the core is not greater than 0.1%.

Item 71. The abrasive article of any of items 55-70, wherein the bonded abrasive body comprises abrasive particles selected from the group consisting of diamond, cubic boron nitride, silicon carbide, boron carbide, alumina, silicon nitride, tungsten carbide, zirconia, or a combination thereof.

Item 72. The abrasive article of item 71, wherein the abrasive particles comprise diamond.

Item 73. The abrasive article of any of items 55-72, wherein a bond material of the bonded abrasive body includes Cu, Sn, Fe, W, WC, Co, Ti or any combination thereof.

Item 74. The abrasive article of any of items 55-73, wherein the core provides a volume amount of at least about 60 vol % and not greater than about 99 vol %, such as at least about 70 vol % and not greater than about 95 wt %, or at least about 80 vol % and not greater than 95 wt % based on the total volume amount of the core and the bonded abrasive body.

Item 75. The abrasive article of any of items 55-74, wherein a ratio of a maximum diameter of the core to a maximum thickness of the core is between about 30:1 to about 10:1.

Item 76. The abrasive article of any of items 55-75, wherein a ratio of a maximum thickness of the bonded abrasive body to a maximum thickness of the core is between about 5:1 to about 1:5.

Item 77. The abrasive article of any of items 55-76, wherein the core is in direct contact with the bonded abrasive body.

Item 78. The abrasive article of any of items 55-77, further comprising a vibration damping layer disposed between at least a portion of the core and a portion of the bonded abrasive body.

Item 79. The abrasive article of item 78, wherein the vibration damping layer comprises a polymer material.

Item 80. The abrasive article of item 79, wherein the polymer material of the vibration damping layer includes silicone, a thermoplastic or a thermoset rubber, a thermoplastic elastomer, a polyurethane, or a combination thereof.

Item 81. The abrasive article of item 80, wherein the polymer material comprises silicone.

Item 82. The abrasive article of item 81, wherein the vibration damping layer consists essentially of silicone.

Item 83. The abrasive article of any of items 78-82, wherein the vibration damping layer has a tensile modulus of at least 50.

Item 84. The abrasive article of any of items 78-83, wherein the vibration damping layer has a compressive modulus of at least 0.2 MPa.

Item 85. The abrasive article of any one of items 78-84, wherein a thickness of the vibration damping layer is reduced by at least 3% at a pressure of at least 10 MPa , based on a thickness of the vibration damping layer at 0.1 MPa.

Item 86. The abrasive article of any one of items 78-85, further comprising a coupling connection between the core and the bonded abrasive body.

Item 87. The abrasive article of item 86, wherein the coupling connection is a mechanical interlock having a dovetail structure.

Item 88. The abrasive article of any of items 55-87, wherein the abrasive article is an abrasive wheel.

Item 89. The abrasive wheel of item 88, wherein the abrasive wheel has a burst strength of at least 150 m/s.

Item 90. The abrasive wheel of items 88 or 89, wherein the abrasive wheel is configured for shaping a workpiece comprising glass.

EXAMPLES

The following non-limiting examples illustrate the present invention.

Selection of the Core Material

Six thermoplastic resin materials were evaluated regarding material properties that may be relevant to form strong cores of abrasive articles. The material properties of six exemplary resin materials are shown in Table 1.

TABLE 1

| | | E1 | E2 | E3 | E4 | E5 | E6 |
|---|---|---|---|---|---|---|---|
| Polymer | | PBT | Nylon 66 | PPS | Nylon 66 | PPS | PC-ABS |
| Fiber Filler | | 45% glass | 35% glass | 40% glass | 33% glass | 40% carbon | 40% glass |
| Trade Name/ Grade | | Crastin SK608 | Zytel 70G35HSL | Ryton R-4-220 | Zytel 70G33L1 | Celstran CF-40 | Verton NV008E |
| Tensile Modulus | GPa | 14.1 | 11.2 | >14 | 10.5 | 37.3 | 20.3 |
| Flexural Modulus | GPa | 13.3 | 12.50 | 14.0 | 9.3 | 34.9 | 11.0 |
| Charpy Impact | $KJ/m^2$ | 55 | 90 | 53 | 85 | 165 | 50 |
| Shrinkage Ratio | % | 0.3 | 0.3-0.4 | 0.4 | 0.3 | <0.1 | 0.05 |
| HDT @0.45 MPA | ° C. | 222 | 261 | 254 | 261 | 260 | 143 |
| Average Fiber Aspect Ratio (length to width) | | <10 | <10 | <10 | <10 | 800-1000 | 1000-1200 |

Injection Molding of Grinding Wheel

A disk injection mold with cavity dimensions of 102.25 mm outer diameter and 10.00 mm depth was prepared and an abrasive diamond ring was placed into the mold cavity. The diamond ring had an outer diameter of 102.2 mm, an inner diameter of 88.3 mm and a thickness of 6 mm. The diamond particles of the abrasive ring had an average particle size of 91 μm, and the bond matrix was made from a mixture of Cu, Sn, Fe, and Ti.

The molding trials were conducted in a Van Dorn hydraulic, 120 ton injection molding machine with 38 mm, 21 L/D, 2.4 CR general purpose screw. For the injection molding experiments, the materials E2, E5, and E6 of Table 1 have been selected. Prior to the molding, the polymer materials selected for injection molding were dried for 4 hours at 80° C. in a dehumidifying dryer. The injection molding parameters are listed in the Table 2 below.

TABLE 2

Injection molding process parameters.

| Parameter | Unit | E2 | E5 | E6 |
|---|---|---|---|---|
| Shot size | [mm] | 160.0 | 160.0 | 160 |
| 1-st injection velocity | [mm/sec] | 76.2 | 165.1 | 90.5 |
| 2-nd injection velocity | [mm/sec] | 12.7 | — | 25.4 |
| V1-V2 switchover position | [mm] | 25.4 | — | 25.4 |
| V-P switchover | [mm] | 12.7 | 12.7 | 12.7 |
| Cushion | [mm] | 5.8 | 5.8 | 5.6 |
| Injection Pressure (actual) | [MPa] | 6.9 | 13.8 | 10.3 |
| Packing Pressure | [MPa] | 6.9 | 13.8 | 10.3 |
| Holding Pressure | [MPa] | 5.2 | 6.9 | 8.3 |
| Holding time | [sec] | 10 | 15 | 10 |
| Cooling time | [sec] | 30 | 75 | 60 |
| Zone 1 Temperature | [° C.] | 282 | 321 | 280 |
| Zone 2 Temperature | [° C.] | 288 | 321 | 285 |
| Zone 3 Temperature | [° C.] | 293 | 327 | 290 |
| Nozzle Temperature | [° C.] | 296 | 338 | 290 |
| Mold Temperature | [° C.] | 27 | 116 | 85 |
| Screw Speed | [rpm] | 200 | 100 | 100 |
| Back Pressure | [MPa] | 1.4 | 1.4 | 1.4 |
| Decompression | [mm] | 2.5 | 0 | 2 |

A comparison of the grinding performance and related product properties of the injection molded grinding wheels made with matrials E2, E5, and E6 can be seen in Table 3:

TABLE 3

| | | E2 | E5 | E6 |
|---|---|---|---|---|
| Core polymer | | Nylon 66 | PPS | PC-ABS |
| Core filler | | 35% glass | 40% carbon fiber | 40% glass fiber |
| Fiber aspect ratio | | 3-6 | 800-1000 | 1000-1200 |
| Out of Balance | [g] | 40 | 13 | 18 |
| Specific Grinding Energy | [J/cc] | 5937 | 1500-2000 | |
| Adhesion between ring and core | | Presence of gap, indicating too much shrinkage | No visible gap between core and diamond ring | No visible gap between core and diamond ring |
| Actual Shrinkage | [%] | 0.76 | 0.02 | 0.01 |
| G ratio | | 13,000 | 71,101 | |
| Burst test (average of 3 tests) | [m/s] | — | 177 | 158 |

Based upon the foregoing data it is noted that controlling the core material with regard to HDT at 0.45 MPa, shrinkage ratio, tensile modulus, and type and average aspect ratio of included reinforcing fibers may facilitate improved performance of the grinding wheels.

Determination of Shrinkage Ratio

For the determination of the shrinkage ratio a specifically designed test mold was used with an inner diameter of 150 mm and a total volume of 238 $cm^3$. The "shrinkage ratio" was calculated according the equation $(1-L_1/L_2)\times 100\%$, wherein $L_2$ represents the dimension of the test mold cavity, and $L_1$ represents the dimension of the material formed in the test mold at room temperature (20° C.). For the shrinkage ratio, the linear shrinkage ratio was calculated, which is the ratio of the linear dimensional change in relation to the original dimension.

Measurement of the HDT @ 0.45 MPa

The HDT @0.45 MPa was measured according to standardized test ASTM D 648-07, which is expressly incorporated by reference herewith.

Measurement of the Tensile Modulus

The MOE was measured according to standardized test ASTM D 638-08, which is expressly incorporated by reference herewith.

Measurement of the Compressive Modulus (CM)

The CM was measured according to standardized test ASTM D 695-10, which is expressly incorporated by reference herewith.

Measurement of Flexural Modulus

The Flexural Modulus was measured according to standardized tests ASTM D 790-10 and D 6272-10, which are expressly incorporated by reference herewith.

Measurement of Charpy Impact

The Charpy Impact was measured according to standardized test ASTM D 6110-10, which is expressly incorporated by reference herewith.

Measurement of Out of Balance

The "Out of Balance" parameter was measured with a Hines balancer HVR-50 at a measuring speed of 630 rpm.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of the invention.

What is claimed is:

1. An abrasive article, comprising:

a bonded abrasive body disposed on a core, wherein the core comprises a polymer material and reinforcing fibers, and wherein the core comprises a shrinkage ratio of not greater than 3%, and further wherein the reinforcing fibers comprise an average aspect ratio of length to width of 10 to 5000.

2. The abrasive article of claim 1, wherein the core has a shrinkage ratio within a range of 0.005% and not greater than 1%.

3. The abrasive article of claim 1, wherein the core has a tensile modulus of at least 15 GPa.

4. The abrasive article of claim 3, wherein the core has a tensile modulus within a range of at least 15 GPa to 150 GPa.

5. The abrasive article of claim 1, wherein the bonded abrasive body is disposed on a peripheral surface of the core.

6. The abrasive article of claim 1, wherein the bonded abrasive body is disposed within a recess of a peripheral surface of the core.

7. The abrasive article of claim 1, wherein the reinforcing fibers comprise an average aspect ratio of length to width of at least about 500 and not greater than about 3000.

8. The abrasive article of claim 1, wherein the core has a heat deflection temperature (HDT) of at least at least about 130 C.

9. The abrasive article of claim 8, wherein the core has a heat deflection temperature (HDT) of not greater than about 400 C.

10. The abrasive article of claim 1, wherein the polymer material includes at least one of a polyamide (PA), a polybutylene terephthalate (PBT), a polyphenylene sulfide (PPS), ethylene tetrafluoroethylene (ETFE), a polyetherketone (PEEK), a polyester (PE), a polyethyleneimine (PEI), a polyethersulfone (PESU), a polyethylene terephthalate (PET), a polyphthalamide (PPA), a poly (p-phenylene sulfide), a polycarbonate (PC), an acrylonitrile-butadiene-styrene (ABS), a PC-ABS, or any combination thereof.

11. The abrasive article of claim 1, wherein the reinforcing fibers include at least one of glass fibers, carbon fibers, ceramic fibers, organic fibers, mineral fibers, or any combination thereof.

12. The abrasive article of claim 11, wherein the reinforcing fibers include glass fibers or carbon fibers.

13. The abrasive article of claim 1, wherein the reinforcing fibers are present in an amount within a range of 5 to 50 wt % based on the total weight of the core.

14. The abrasive article of claim 1, wherein the core consists essentially of the polymer material and the reinforcing fibers, the reinforcing fibers being present in an amount of 5 to 50 wt % based on the total weight of the core and having an average aspect ratio of length to width of 500 to 3000.

15. The abrasive article of claim 14, wherein the polymer material includes PPS, PC-ABS, or any combination thereof.

16. The abrasive article of claim 1, further comprising a vibration damping layer disposed between at least a portion of the core and a portion of the bonded abrasive body, wherein the vibration damping layer has a tensile modulus of at least 50 MPa.

17. The abrasive article of claim 1, wherein the the core comprises a shrinkage ratio within a range including at least 0.005% and not greater than 0.1%, a tensile modulus within a range including at least 15 GPa and not greater than 150 GPa, and wherein the reinforceing fibers have an average aspect ratio of length to width of 500 to 3000.

18. The abrasive wheel of claim 1, wherein the abrasive wheel has a burst strength of at least 150 m/s.

19. The abrasive article of claim 1, wherein the polymer material includes at least one of PPS, PC-ABS, or a combination thereof and the reinforcing material comprises carbon fibers or glass fibers having an average aspect ratio of length to width of 500 to 3000.

20. The abrasive article of claim 1, wherein the core further comprises an inner portion and an outer radial portion disposed circumferentially around the periphery of the inner portion, and wherein the outer radial portion comprises a thickness ($T_{or}$) different than a thickness of the inner portion ($T_{ir}$).

* * * * *